US005540512A

United States Patent [19]

Pinzauti

[11] Patent Number: 5,540,512

[45] Date of Patent: Jul. 30, 1996

[54] PORTFOLIO SUITABLE FOR STORAGE AND DISPLAY OF MULTILEAF SPECIMENS

[76] Inventor: Jane H. Pinzauti, 1705 Chatsworth La., Raleigh, N.C. 27614

[21] Appl. No.: 285,789

[22] Filed: Aug. 4, 1994

[51] Int. Cl.[6] ..... B42D 12/00

[52] U.S. Cl. ..... 402/79; 402/80 R; 283/63.1; 281/28; 281/34; 281/51

[58] Field of Search ..... 402/79, 80 R; 281/22, 16, 28, 31, 34, 38, 45, 44, 51, 192; 283/63.1

[56] References Cited

U.S. PATENT DOCUMENTS

| | | | |
|---|---|---|---|
| 115,896 | 6/1871 | Rile | 281/22 |
| D. 175,722 | 10/1955 | Graham . | |
| 434,724 | 8/1890 | Rigby | 281/16 |
| 1,333,521 | 3/1920 | Wheeler | 281/34 |
| 1,963,552 | 6/1934 | Horwitt . | |
| 2,588,152 | 3/1952 | Newman | 281/30 X |
| 2,742,070 | 4/1956 | Jones | 281/34 X |
| 3,242,596 | 3/1966 | Smith | 281/16 X |
| 3,755,925 | 9/1973 | Court . | |
| 4,157,875 | 6/1979 | Smith et al. . | |
| 4,534,582 | 8/1985 | Howard | 281/34 X |
| 4,630,843 | 12/1986 | Willat . | |
| 4,676,527 | 6/1987 | Palmer . | |
| 4,932,679 | 6/1990 | Mayer et al. | 281/16 X |
| 4,962,951 | 10/1990 | Mechesney | 281/34 X |
| 5,174,674 | 12/1992 | Norwood . | |
| 5,275,438 | 1/1994 | Struhl . | |
| 5,286,112 | 2/1994 | Bible . | |
| 5,433,317 | 7/1995 | Roser . | |

FOREIGN PATENT DOCUMENTS

0520878A1 12/1992 European Pat. Off. .

*Primary Examiner*—Frances Han

*Attorney, Agent, or Firm*—Bell, Seltzer, Park & Gibson, P.A.

[57] ABSTRACT

A portfolio for securing a multileaf specimen on a page of the portfolio includes a plurality of pages bound together at respective edges. A multileaf specimen including a plurality of connected leaves is fixed via its base leaf to a predetermined one of the portfolio pages. The plurality of leaves is movable between a closed position, wherein the leaves are arranged in stacked relation, and an open, unsecured position to facilitate viewing. The multileaf specimen is secured in the closed position by a securing strap having a first end adhesively secured to one of the plurality of leaves and a second end releasably secured to the predetermined page adjacent the multileaf specimen. As such, the multileaf specimen is releasably secured in the closed position.

15 Claims, 2 Drawing Sheets

PORTFOLIO SUITABLE FOR STORAGE AND DISPLAY OF MULTILEAF SPECIMENS

FIELD OF THE INVENTION

The present invention relates generally to devices used to display artistic specimens and, more particularly, to portfolios for displaying such specimens.

BACKGROUND OF THE INVENTION

Many commercial artists and designers store and display samples of their work within portfolio-style display units. These units typically comprise multiple pages contained within a notebook or binder that is configured to permit insertion, removal, or substitution of pages as the artist's work is updated. Each page of the portfolio typically comprises a paper or paperboard sheet that is overlaid on either side with a transparent plastic sheet, thereby forming a pocket between the plastic sheet and the paper. The specimen to be displayed is placed within the pocket, from which it can be viewed easily and conveniently while protected from being bent, creased, stained, or otherwise marred.

The configuration described above is generally regarded as being quite satisfactory for displaying specimens, such as advertisements, drawings, photos, and the like, that comprise only a single sheet or leaf. However, this configuration is not particularly suitable for specimens, such as advertising brochures, leaflets, pamphlets, booklets, and the like, that include multiple leaves arranged in overlying layers. Once the multileaf specimen is placed within the pocket of a portfolio page, only its uppermost leaf can be viewed; examination of leaves that underlie the uppermost leaf requires that the specimen be removed from the pocket. In addition, one perusing the portfolio cannot easily discern whether a particular specimen has multiple leaves without removing it from the pocket. This is particularly problematic when the artist is not present to point out during examination of the portfolio which specimens have multiple leaves. Displaying the specimen by attaching it to the front surface of the plastic sheet (i.e., outside the pocket) has proven to be unsatisfactory, as the cover of a specimen so displayed tends to open and be bent, crushed, or creased, which spoils its appearance.

The prior art includes devices for the storage of items having multiple leaves, but has not addressed the specific problem of simultaneously displaying a multileaf specimen for viewing while simultaneously protecting it from being creased or bent. For example, U.S. Pat. No. 4,676,527 to Palmer discusses a folder specifically for use by athletic coaches. The folder comprises hinged front and back covers. A pair of latching tabs are permanently fixed at one end to the back cover. The free end of each tab includes a Velcro® patch. The patch is positioned to attach to a corresponding mating patch mounted on one or more individual custom-formed athletic field diagrams sized to fit within the folder to secure them in place temporarily. U.S. Pat. No. 4,157,875 to Smith et al. discusses a binder for a multipage computer printout. The binder comprises a back cover and a clear front cover, each of which is attached at one edge to a spine. The front and back covers include Velcro® patches located on their upper surfaces that mate when the binder is folded back upon itself to facilitate storage. U.S. Pat. No. 3,755,925 to Court discusses a specimen book that includes a storage tray attached to the book's back cover and multiple pages of sheets attached to the book's front cover.

In view of the foregoing, it is an object of the present invention to provide a portfolio that enables a multileaf specimen to be displayed and easily recognized as such, thereby making an observer of the specimen aware that the specimen includes additional leaves to be examined.

It is another object of the present invention to provide a portfolio that enables all of the leaves of a multileaf specimen to be easily and conveniently examined.

It is a further object of the present invention to provide a portfolio that secures a multileaf specimen so that the likelihood of the leaves being bent or creased is substantially reduced.

SUMMARY OF THE INVENTION

These and other objects are satisfied by the present invention, which is a portfolio including means for securing a multileaf specimen on a page so that the specimen can be displayed and examined easily, yet is secured in such a manner that the risk of damage, such as bending or creasing of its leaves, is considerably reduced. The portfolio comprises a plurality of pages bound together at respective edges. A multileaf specimen comprising a plurality of connected leaves is fixed via its base leaf to a predetermined one of the portfolio pages. The plurality of leaves is movable between a closed position, wherein the leaves are arranged in stacked relation, and an open position wherein the leaves are accessible for viewing. The multileaf specimen is secured in the closed position by a securing strap having a first end adhesively secured to one of the plurality of leaves and a second end releasably secured to the predetermined page adjacent the multileaf specimen. As such, the multileaf specimen is releasably secured in the closed position, yet readily examined by releasing the securing strap from the page.

Preferably, the securing strap comprises a flexible, transparent material, which at one end carries an adhesive layer, and at its other end carries releasable securing means, such as a patch of one of hook and loop material, for releasably securing the strap to the portfolio page. In addition, it is preferred that the strap include a grasping flap that extends from the releasable securing means for convenient grasping.

DETAILED DESCRIPTION OF THE INVENTION

The present invention will now be described in detail hereinafter by reference to the accompanying drawings. The invention is not intended to be limited to the embodiment described; rather, this description is included to fully convey the scope of the invention to those skilled in this art.

Figure 3:
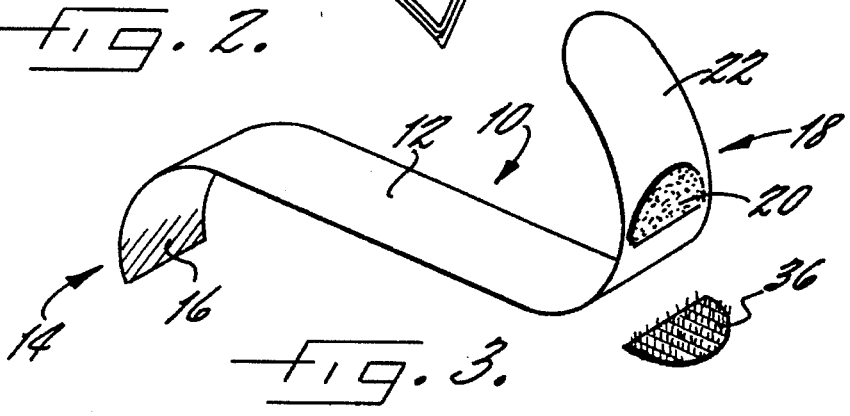
FIG. 3 is a greatly enlarged perspective view of the securing strap as shown in FIGS. 1 and 2.

Referring now to the drawings, a securing strap 10 is illustrated for use in a portfolio 5 to secure a multileaf specimen 30 in a closed position, yet readily permit viewing or examination. The strap 10 (FIG. 3) comprises a body portion 12 and opposite end portions 14, 18. The end portion 14 includes an adhesive layer 16 on its lower surface. The end portion 18 includes a grasping flap 22 and a patch 20 formed of one of releasable "hook and loop" material such as that sold under the trademark VELCRO®. The patch 20 is mounted on the lower surface of the end portion 18 and is positioned between the flap 22 and the remainder of the body portion 12.

The body portion 12 is preferably formed of a material that has sufficient flexibility to enable the body portion 12 to be easily bent or otherwise manipulated during use. Exemplary materials having such flexibility include polymers such as polyethylene, polypropylene, polyurethane, polyacrylate, nylon, and the like. Preferably, the body portion 12 is transparent so that attachment thereof to a display specimen does not detract from the appearance or obstruct the image of that specimen. Typically, the body portion 12 is a strip of material between about 1½ and 2½ inches in length.

As stated above, the end portion 14 includes an adhesive layer 16 on its underside. The adhesive comprising the adhesive layer 16 can be any known to those skilled in this art to be suitable to adhere adjacent surfaces. Exemplary adhesives include pressure-sensitive adhesives and moisture-activated dextrin-based adhesives. It is preferred that the adhesive comprising the adhesive layer 16 have sufficient adhesive strength that the end portion 14 remains adhered to an underlying multileaf specimen during normal use, but that the adhesive have sufficient release properties that the end portion can be detached from the specimen without marring its appearance. Thus, pressure-sensitive adhesives such as natural rubber-based adhesives, which are typically used as the adhesive for general purpose tape rolls, are particularly preferred for use with the present invention.

The opposite end portion 18 includes a securing patch 20 and a grasping flap 22. The patch 20, which is positioned on the underside of the strap 10 between the grasping flap 22 and the body portion 12, is preferably formed of one of hook-and-loop material; if so, the portfolio page underlying the patch 20 should include a mating one of hook and loop material so that the strap 10 is releasably secured thereto. However, those skilled in this art will appreciate that any means for releasably securing the strap 10 to an underlying portfolio page, such as a releasable pressure-sensitive adhesive, a clip or button configuration, or the like, is suitable for use with the present invention.

The grasping flap 22 extends from the securing patch 20 so that the patch 20 is positioned between the flap 22 and the body portion 12. The flap 22 should be of sufficient length and flexibility to be easily grasped by one wishing to manipulate the strap 10. Typically, a flap length of between about ¾ and 1¼ inches is suitable. Preferably, the flap 22 and the body portion 12 are integrally formed from the same strip of material. Stated in other terms, the patch 20 may be positioned inward from the end to define the flap 22.

Figure 1:
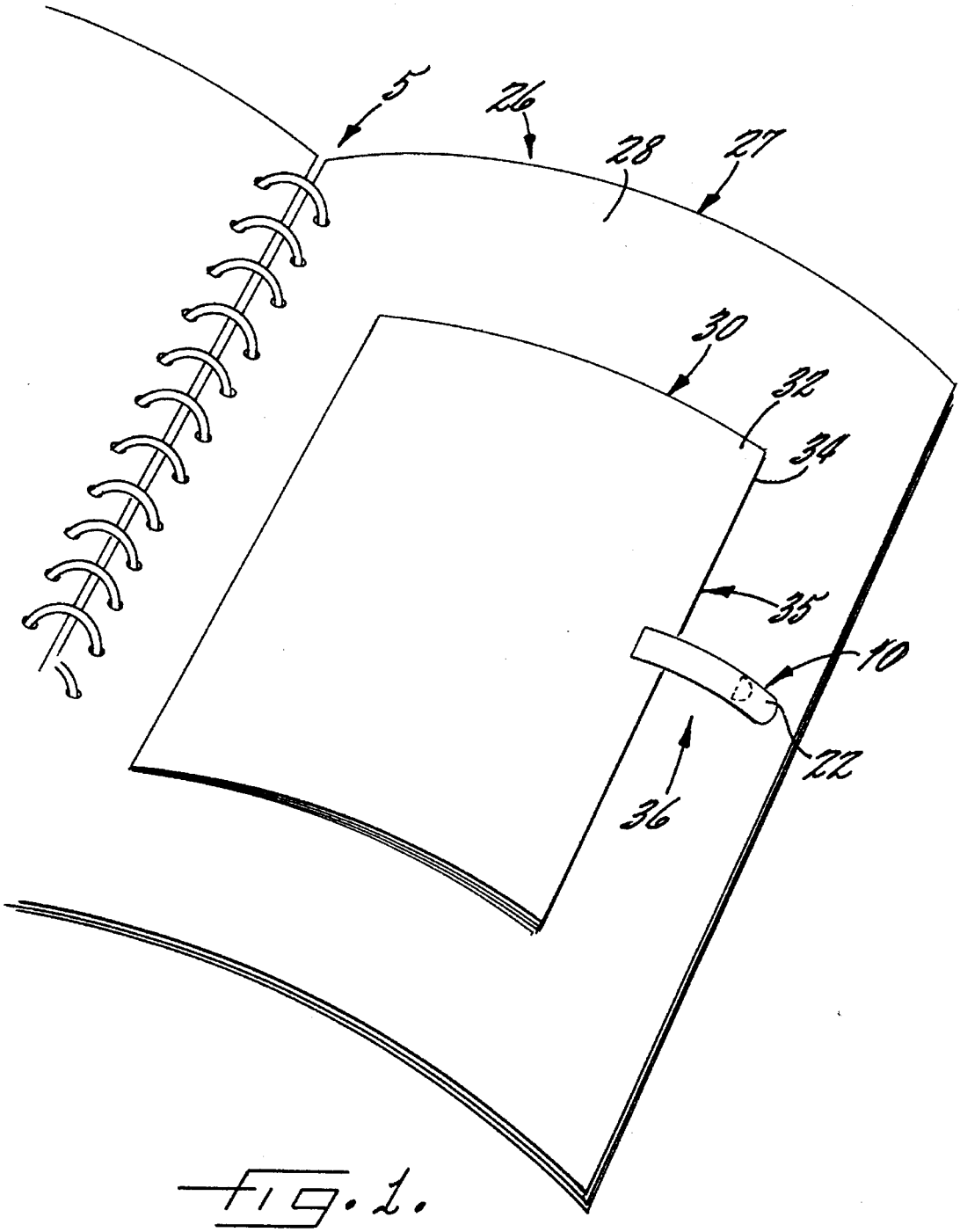
FIG. 1 is a perspective view of the portfolio according to the invention illustrating a multileaf specimen fixed to a page of the portfolio secured in the closed position by the securing strap.
Figure 2:
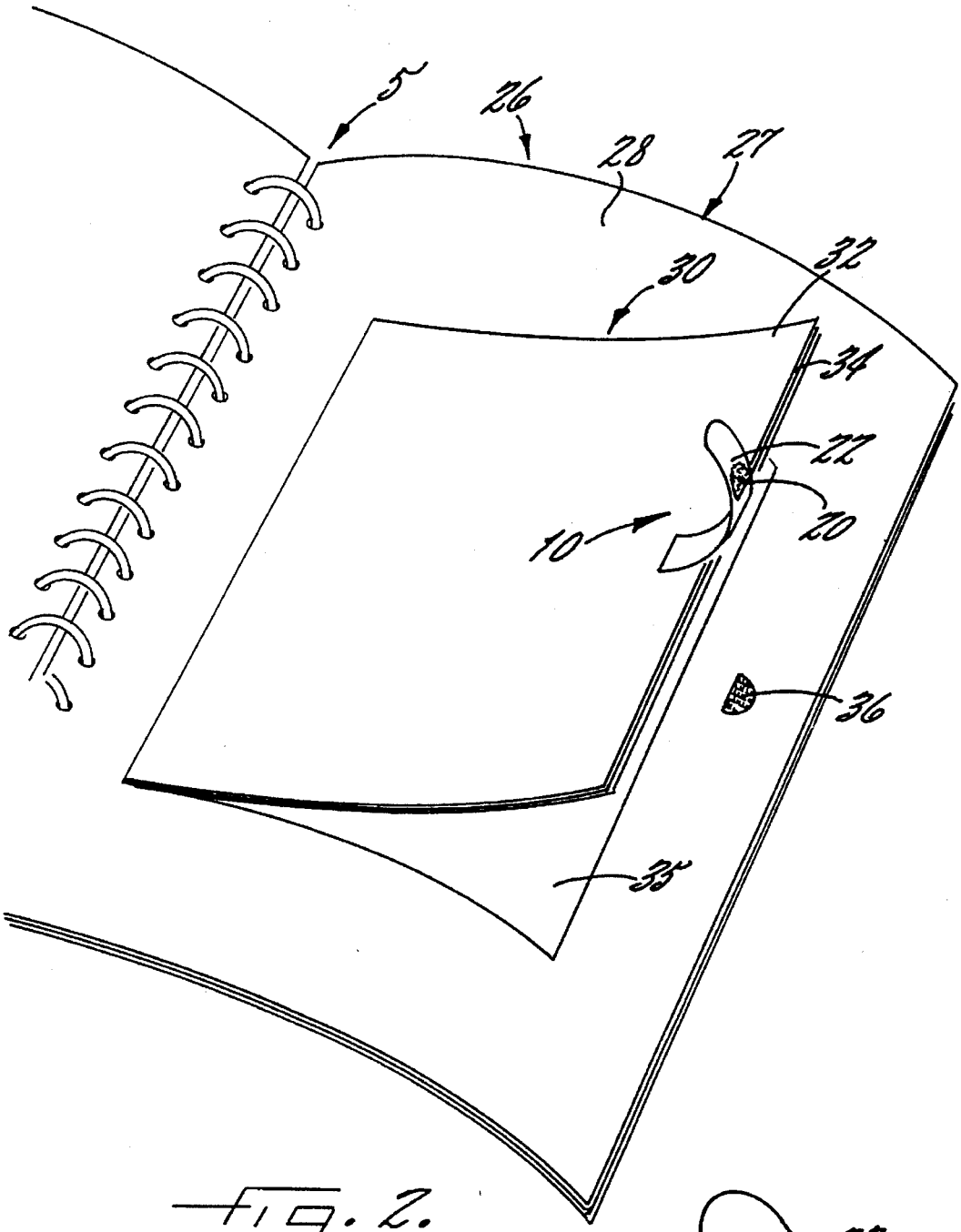
FIG. 2 is a perspective view of the portfolio shown in FIG. 1 illustrating the securing strap released and the multileaf specimen in the open position.

The use and utility of the strap 10 in combination with a portfolio 5 and a multileaf specimen 30 is illustrated particularly in FIGS. 1 and 2, each of which shows the strap 10 attached to the multileaf specimen fixed to a portfolio-style page 26. The portfolio page 26, which is exemplary of a conventional portfolio page and which is one of a plurality of portfolio pages bound together at respective edges thereof to comprise the portfolio 5, comprises an opaque inner sheet 27 and a transparent outer sheet 28, between which is formed a pocket. Those skilled in this art will appreciate that, although a pocket-style page 26 is illustrated herein and is preferred, any type of page, including single sheet pages, could also be used with the present invention. A hook and loop material patch 36 is fixed, preferably through an adhesive, to the outer surface of the outer sheet 28 in a position in which it can mate with the patch 20 of the strap 10.

The multileaf specimen 30 comprises several leaves 34 that overlie a base leaf 35 and underlie an uppermost leaf 32. The base leaf 35 is fixed to the outer surface of the outer sheet 28 (i.e., the surface of the outer sheet facing away from the inner sheet) so that the remaining leaves 34 and 32 are free to open for examination. Those skilled in this art will appreciate that, although several leaves 34 are illustrated herein, specimens that comprise as few as two leaves, such as a folder-style specimen simply having hinged front and back covers, are contemplated by the invention. In addition, although a booklet-style specimen 30, wherein the leaves are attached at one side, is illustrated herein, other specimens, such as accordion-style specimens in which adjacent leaves are attached at opposed edges, that can be arranged in a closed position in which the leaves are arranged in stacked relation, can also be used with the present invention.

To attach the strap 10 to the specimen 30 and page 26, the strap 10 is adhered to the uppermost leaf 32 via the adhesive layer 16. The securing tab 20 is then aligned with its mating tab 36 and pressure is applied thereto to form a releasable bond. In this closed portion, the strap 10 secures the uppermost leaf 32 in a flat condition; the leaf 32 cannot open unless the strap 10 is detached. As a result, the leaf 32 and the other leaves 34 are prevented from being bent or creased due to use of the portfolio 25. The strap 10 also provides an indicator to one examining the portfolio 25 that the specimen 30 is a multileaf specimen that has additional layers that can be examined; thus, even when an artist has to drop off the portfolio instead of presenting it directly to the observer, the observer can still be made aware of which specimens have multiple leaves.

The internal leaves 34 of the specimen 30 can be accessed by pulling upwardly (i.e. away from the portfolio page 26) on the grasping flap 22. This action detaches the patch 20 from the patch 36, thereby enabling the uppermost leaf 32 to be lifted and the underlying leaves 34 to be examined. When examination of the specimen 30 is complete, the patch 20 is lowered onto the patch 36, which resecures the strap 10 and, thereby, the multileaf specimen 30 in its closed position.

As can be seen from the foregoing discussion, the securing strap 10 of the present invention provides a means whereby a multileaf specimen can be stored and displayed in a portfolio-style display unit for convenient inspection of all of its pages. In addition, the leaves, and in particular the uppermost leaf, of the multileaf specimen are protected from being bent or creased. Further, the securing strap 10 enables the specimen 30 to be positioned virtually anywhere on the portfolio page. This versatility of positioning permits the artist to display a variety of specimen sizes and configurations, including horizontal and vertical formats and booklet-style and accordion-style brochures.

The foregoing embodiment is illustrative of the present invention, and is not to be construed as limiting thereof. The invention is defined by the following claims, with equivalents of the claims to be included therein.

That which is claimed is:

1. A portfolio for holding and facilitating display of a plurality of specimens, said portfolio comprising:

a plurality of pages bound together at respective edges thereof;

a multileaf specimen comprising a plurality of connected leaves and having a base leaf fixed to a predetermined one of said plurality of pages, said plurality of connected leaves being movable between a closed position, wherein the leaves are arranged in stacked relation, and an open position, wherein the leaves are accessible for viewing; and a securing strap having a first end adhesively secured to one of said plurality of leaves and a second end releasably secured to the predetermined page adjacent said multileaf specimen for releasably securing same in the closed position on the predetermined page.

2. A portfolio as defined in claim 1, wherein said securing strap is formed of a flexible material.

3. A portfolio as defined in claim 1, wherein said securing strap is formed of a transparent material.

4. A portfolio as defined in claim 1, wherein said first end is adhesively secured to one of said plurality of leaves with a permanent adhesive.

5. A portfolio as defined in claim 1, further comprising a first patch of one of releasable hook and loop material fixed adjacent the second end of said strap, and a second patch of an opposite one of releasable hook and loop material attached to the predetermined page to releasably mate with said first patch.

6. A portfolio as defined in claim 5, wherein said first patch is positioned inward from the second end of said strap to thereby define a grasping flap of material at the second end of said strap.

7. A portfolio as defined in claim 1, wherein said strap has a strip shape with a length between about 1½ and 2½ inches.

8. A portfolio as defined in claim 6, wherein said first patch is positioned between about ¾ and 1¼ inches in length from said second end.

9. A portfolio as defined in claim 1, wherein said predetermined page comprises an inner background sheet and a transparent outer sheet overlying said inner background sheet, and wherein said base leaf of said multileaf specimen is fixed to an outer surface of said transparent sheet.

10. A portfolio for holding and facilitating display of a plurality of specimens, said portfolio comprising:

a plurality of pages bound together at respective edges thereof;

a multileaf specimen comprising a plurality of connected leaves and having a base leaf fixed to a predetermined one of said plurality of pages, said plurality of connected leaves being movable between a closed position, wherein the leaves are arranged in stacked relation, and an open position, wherein the leaves are accessible for viewing; and a securing strap having a first end adhesively secured to one of said plurality of leaves; and first and second releasable fastening means carried by a second end of said securing strap and the predetermined page, respectively, for releasably securing said multileaf specimen in the closed position on the predetermined page.

11. A portfolio as defined in claim 10, wherein said securing strap is formed of a flexible material.

12. A portfolio as defined in claim 10, wherein said securing strap is formed of a transparent material.

13. A portfolio as defined in claim 10, further comprising a first patch of one of releasable hook and loop material fixed adjacent the second end of said strap, and a second patch of an opposite one of releasable hook and loop material attached to the predetermined page to releasably mate with said first patch.

14. A method of releasably securing the leaves of a multileaf specimen in a closed position on a predetermined page of a portfolio, a base leaf of the multileaf specimen being fixed to the predetermined page of the portfolio, and the closed position being defined by the leaves being arranged in stacked relation, said method comprising the steps of:

adhering one end of a securing strap to an uppermost leaf of the multileaf specimen; and releasably securing a second opposite end of the securing strap to the predetermined page adjacent the multileaf specimen, thereby releasably securing the multileaf specimen in the closed position on the predetermined page.

15. The method defined in claim 14, wherein the releasably securing step comprises contacting a patch formed of one of hook and loop material attached adjacent the second end of the strap to a patch of the opposite one of hook and loop material attached to the predetermined page.

* * * * *